US008545184B2

(12) United States Patent
Garcia-Crespo et al.

(10) Patent No.: US 8,545,184 B2
(45) Date of Patent: Oct. 1, 2013

(54) LOCKING SPACER ASSEMBLY

(75) Inventors: Andres Jose Garcia-Crespo, Greenville, SC (US); Matthew Stephen Casavant, Greenville, SC (US)

(73) Assignee: General Electric Company, Schenectady, NY (US)

( * ) Notice: Subject to any disclaimer, the term of this patent is extended or adjusted under 35 U.S.C. 154(b) by 941 days.

(21) Appl. No.: 12/652,159

(22) Filed: Jan. 5, 2010

(65) Prior Publication Data

US 2011/0164983 A1 Jul. 7, 2011

(51) Int. Cl.
*F01D 5/30* (2006.01)

(52) U.S. Cl.
USPC ..... 416/220 R

(58) Field of Classification Search
USPC ..... 416/220 R, 216, 215, 217
See application file for complete search history.

(56) References Cited

U.S. PATENT DOCUMENTS

| | | | | |
|---|---|---|---|---|
| 4,915,587 | A | 4/1990 | Pisz et al. | |
| 5,431,543 | A | 7/1995 | Brown et al. | |
| 2006/0222502 | A1 | 10/2006 | Hansen et al. | |
| 2011/0110782 | A1 * | 5/2011 | Brittingham | 416/215 |

* cited by examiner

*Primary Examiner* — Dwayne J White
(74) *Attorney, Agent, or Firm* — Sutherland Asbill & Brennan LLP

(57) ABSTRACT

The present application describes a locking spacer assembly for use with a groove in a rotating disk. The locking spacer assembly may include a locking spacer with a leg and a wedge tool in contact with the leg so as to pull the leg inward and into the groove.

20 Claims, 2 Drawing Sheets

LOCKING SPACER ASSEMBLY

TECHNICAL FIELD

The present application relates generally to turbine engines and more particularly relates to a locking spacer assembly for use with the final circumferential compressor blade and the like.

BACKGROUND OF THE INVENTION

The compressor and turbine sections of a turbine engine generally include rotors with a number of blades attached thereto. The blades are generally arranged in axially spaced rows or stages along the rotor. Each blade is releasably attached to a groove within each rotor and locked into place.

Specifically, the blades and the spacers generally may be inserted at about a ninety degree angle (90°) relative to their loading position. The blades and spacers may then be rotated into place. The final blade or spacer, however, may not have enough circumferential room to be inserted perpendicularly. As such, the final blade or spacer generally must be placed directly therein. Known methods to position the last spacer generally have involved multi-part spacers with difficult assembly procedures and possibly uneven axial loads.

There is therefore a desire for improved compressor and turbine blade assemblies and methods of installing the same, particularly in the final slot. Such an assembly may be applicable to any type of rotating equipment, should be easy to install, and should provide even axial loads.

SUMMARY OF THE INVENTION

The present application thus describes a locking spacer assembly for use with a groove in a rotating disk. The locking spacer assembly may include a locking spacer with a leg and a wedge tool in contact with the leg so as to pull the leg inward and into the groove.

The present application further describes a method of installing a spacer assembly in a final spacer slot. The method may include raising a wedge tool within a locking spacer of the spacer assembly, contacting one or more legs of the locking spacer with the wedge tool, pulling the one or more legs inward, and positioning the spacer assembly straight into the final spacer slot.

The present application further describes a compressor stage. The compressor stage may include a rotating disk. The rotating disk may include a groove with a number of blades and spacers positioned therein as well as a final spacer slot in the groove. A locking spacer assembly with a pair of legs may be positioned in the final spacer slot. A wedge tool may be in contact with the pair of legs so as to pull the legs inward.

These and other features and improvements of the present application will become apparent to one of ordinary skill in the art upon review of the following detailed description when taken in conjunction with the several drawings and the appended claims.

DETAILED DESCRIPTION

Figure 1:
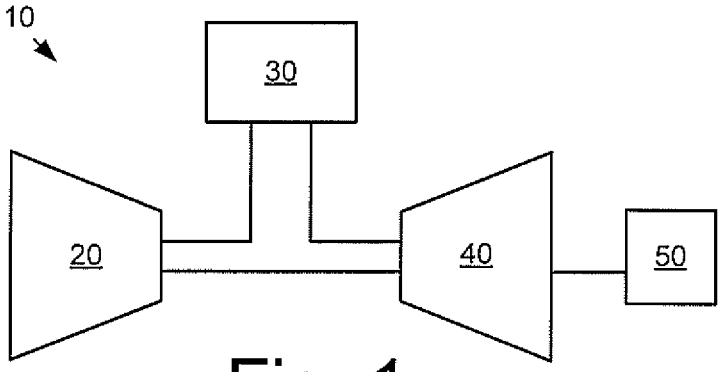
Fig. 1 Prior Art
FIG. 1 is a simplified schematic view of a known gas turbine engine as may be used herein.

Referring now to the drawings, in which like numbers refer to like elements throughout the several views, FIG. 1 shows a schematic view of a gas turbine engine 10. As is known, the gas turbine engine 10 may include a compressor 20 to compress an incoming flow of air. The compressor 20 delivers the compressed flow of air to a combustor 30. The combustor 30 mixes the compressed flow of air with the compressed flow of fuel and ignites the mixture. Although only a single combustor 30 is shown, the gas turbine engine 10 may include any number of combustors 30. The hot combustion gases are in turn delivered to a turbine 40. The hot combustion gases drive the turbine 40 so as to produce mechanical work. The mechanical work produced by the turbine 40 drives the compressor 20 and an external load 50 such as an electrical generator and the like.

The gas turbine engine 10 may use natural gas, various types of syngas, and other types of fuels. The gas turbine engine 10 may be a heavy duty gas turbine model offered by General Electric Company of Schenectady, N.Y. The gas turbine engine 10 may have other configurations and may use other types of components. Other types of gas turbine engines 10 may be used herein. Multiple gas turbine engines, other types of turbines, and other types of power generation equipment also may be used herein together. The present application also may be applicable to steam turbines, aircraft, and other types of rotating equipment.

Figure 2:
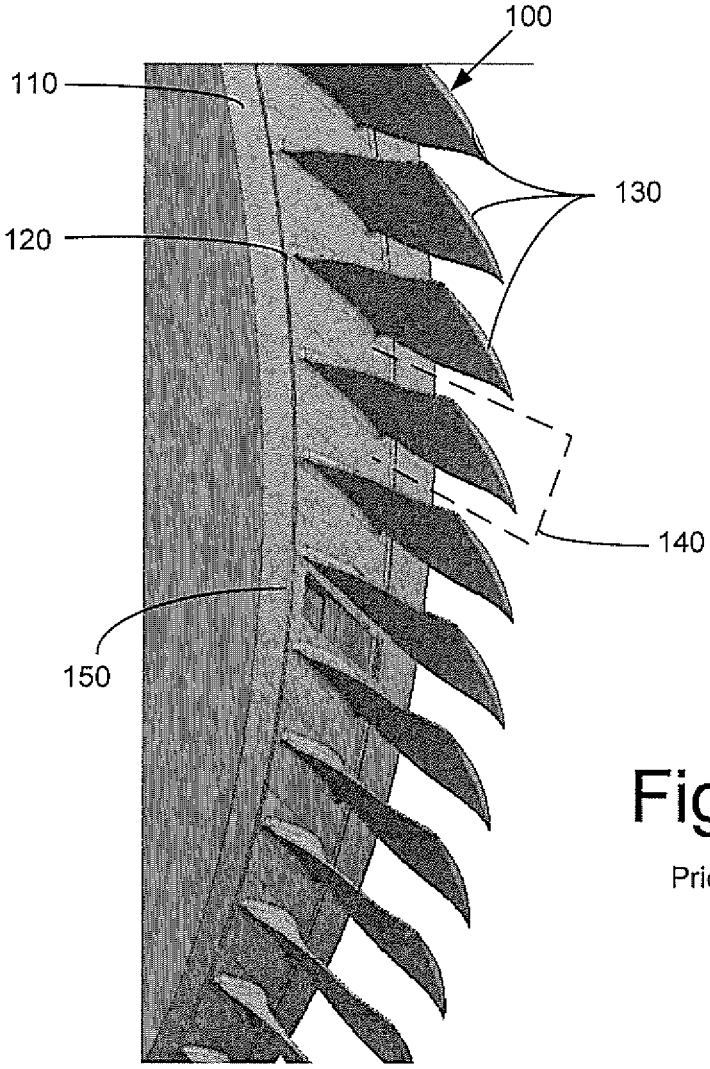
Fig. 2 Prior Art
FIG. 2 is a perspective view of a portion of a known compressor stage as may be used herein.

FIG. 2 shows a portion of a compressor stage 100. The compressor stage 100 includes a disk 110. The disk 110 may include a groove 120 extending circumferentially thereabout. A number of blades 130 and spacers 140 may be positioned within the groove. The blades 130 and the spacers 140 may be positioned in an alternating arrangement. As described above, the blades 130 and the spacers 140 may be installed by inserting the roots of the blades 130 and the spacers 140 one at a time into the groove 120. The blades 130 and the spacers 140 then may be rotated about ninety degrees (90°) until the roots engage the groove 120 of the disk 110. A final spacer slot 150 also is shown.

Figure 3:
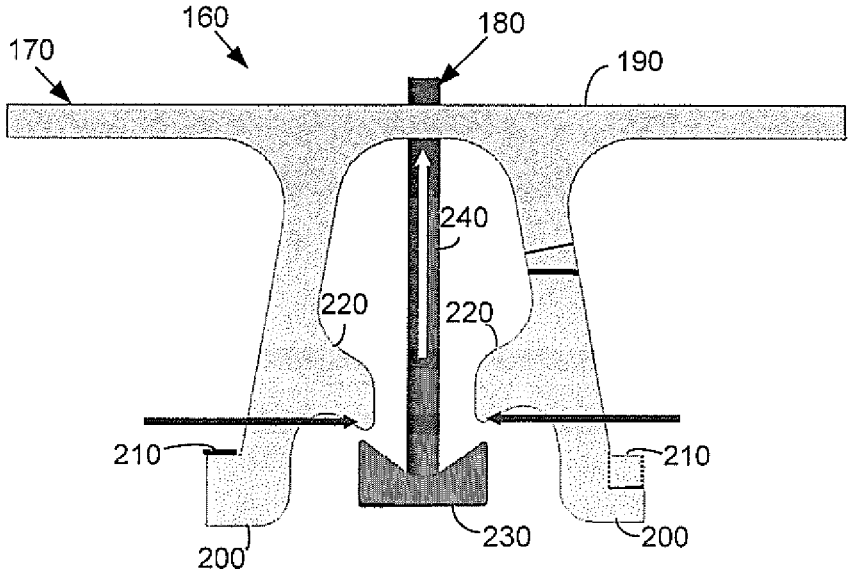
FIG. 3 is a side plan view of the locking spacer assembly as is described herein.
Figure 4:
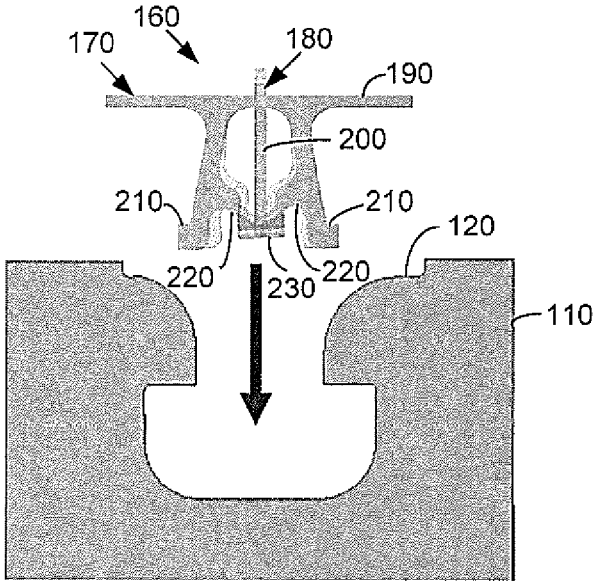
FIG. 4 is a side cross-sectional view of the locking spacer of FIG. 3 as inserted within a compressor stage.

FIG. 3 shows a locking spacer assembly 160 as may be described herein. The locking spacer assembly 160 includes a locking spacer 170 and a wedge tool 180. The locking spacer 170 may be a single element. The locking spacer 170 may include a spacer section 190. The spacer section 190 may be sized and shaped so as to fit snuggly within the final spacer slot 150. Any shape or size may be used herein. The locking spacer 170 further may include one or more legs 200 extending from the spacer section 190. Although a pair of the legs 200 is shown, a single leg 200 also may be used herein. The leg 200 or each of the legs 200 may have a contact surface 210. The contact surface 210 may be sized and shaped to fit within the groove 120 of the disk 110. The leg 200 or legs 200 also may have a wedge surface 220 opposite the contact surface 210. The wedge surface 220 may extend or bulge within the leg 200 or legs 200. The wedge surface 220 may have a downwardly shaped wedge-like shape. Similar shapes also may be used herein. The locking spacer 170 may be made out of a material capable of elastic bending or deformation. For example, certain types of aluminum and other materials may be used herein.

The wedge tool 180 may include an inverted wedge 230. The inverted wedge 230 may have two faces that largely conform to the wedge surfaces 220 of the legs 190 of the locking spacer 170. The "inverted" wedge 230 simply means that it has an opposed surface to that of the wedge surfaces 220. The inverted wedge 230 may be positioned on an extended rod 240 or a similar type of extended member such as a bolt and the like. The rod 240 may extend through and beyond the spacer section 190 of the locking spacer 170. Other shapes may be used herein.

In use, the wedge tool 180 may be pulled radially outward from the spacer section 190 of the locking spacer 170. Pulling the wedge tool 180 upward causes the inverted wedge 230 to contact the wedge surfaces 220 of the legs 200 and move the legs 200 inward. The wedge tool 180 then can be restrained via the rod 240 or otherwise. The locking spacer assembly 160 as a whole then may be inserted straight down into the final spacer slot 150 on the disk 110. Once the locking spacer assembly 160 is in place, the wedge tool 180 may be released such that the contact surfaces 210 of the legs 200 snap into place within the groove 120 of the disk 110. The wedge tool 180 may be extended radially downward and attached to the disk 110 for circumferential restraint or otherwise disposed.

The locking spacer assembly 160 also may be removed by raising the wedge tool 180 such that the inverted wedge 230 pulls the legs 200 inward and out of contact with the groove 120. The locking spacer assembly 160 as a whole then may be removed straight out.

The locking spacer assembly 160 described herein thus provides ease of installation and removal. Moreover, the single piece locking spacer 170 provides for ease of manufacturing. Likewise, the locking spacer 170 may be made out of relatively inexpensive materials. The inward actuation of the legs 200 of the locking spacer 170 provides a far simpler design and ease of installation as compared to the known outwardly actuating devices.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A locking spacer assembly for use with a groove defined in a rotating disk, comprising:

a locking spacer;

the locking spacer comprising a leg configured to elastically bend from a locked position to an unlocked position; and a wedge tool in contact with the leg and configured to pull the leg inward from the locked position to the unlocked position.

2. The locking spacer assembly of claim 1, wherein at least a portion of the locking spacer assembly is configured to be positioned within a final spacer slot of the groove.

3. The locking spacer assembly of claim 1, wherein the locking spacer comprises a pair of legs each configured to elastically bend from the locked position to the unlocked position, and wherein the wedge tool is in contact with the pair of legs and is configured to pull the legs inward from the locked position to the unlocked position.

4. The locking spacer assembly of claim 3, wherein the locking spacer comprises a spacer section connected to and positioned about the pair of legs and configured to be positioned within the final spacer slot.

5. The locking spacer assembly of claim 3, wherein the pair each of the legs comprises a contact surface for contact with the groove.

6. The locking spacer assembly of claim 3, wherein the pair each of the legs comprises a wedge surface for contact with the wedge tool.

7. The locking spacer assembly of claim 6, wherein the wedge tool comprises an inverted wedge for contact with the wedge surfaces of the pair of legs to pull the legs inward from the locked position to the unlocked position.

8. The locking spacer assembly of claim 6, wherein the wedge tool comprises a rod extending through the locking spacer and connected to the inverted wedge.

9. The locking spacer assembly of claim 6, wherein the wedge surface extends inwardly and downwardly.

10. A method of installing a locking spacer assembly in a final spacer slot of a groove defined in a rotating disk, comprising:

raising a wedge tool within a locking spacer of the locking spacer assembly;

contacting one or more legs of the locking spacer with the wedge tool to elastically bend the one or more legs inward from a locked position to an unlocked position; and positioning the spacer assembly straight into the final spacer slot.

11. The method of claim 10, further comprising lowering the wedge tool such that the one or more legs are released from the wedge tool and return to the locked position such that the locking spacer is locked into place in the final spacer slot.

12. A compressor stage, comprising:

a rotating disk;

the rotating disk comprising a groove defined therein;

a plurality of blades and spacers positioned at least partially within the groove;

a final spacer slot defined in the groove;

a locking spacer positioned at least partially within the final spacer slot;

the locking spacer comprising a pair of legs configured to elastically bend from a locked position to an unlocked position; and a wedge tool in contact with the pair of legs and configured to pull the legs inward from the locked position to the unlocked position.

13. The compressor stage of claim 12, wherein the locking spacer comprises a spacer section connected to and positioned about the pair of legs and positioned within the final spacer slot.

14. The compressor stage of claim 12, wherein each of the legs comprises a contact surface for contact with the groove.

15. The compressor stage of claim 12, wherein each of the legs comprises a wedge surface for contact with the wedge tool.

16. The compressor stage of claim 15, wherein the wedge tool comprises an inverted wedge for contact with the wedge surfaces of the pair of legs to pull the legs inward from the locked position to the unlocked position.

17. The compressor stage of claim 16, wherein the wedge tool comprises a rod extending through the locking spacer and connected to the inverted wedge.

18. The compressor stage of claim 15, wherein the wedge surface extends inwardly and downwardly.

19. The compressor stage of claim 16, wherein the inverted wedge extends outwardly and upwardly.

20. The locking spacer of claim 7, wherein the inverted wedge extends outwardly and upwardly.

* * * * *